US008597106B2

(12) United States Patent
Schneider

(10) Patent No.: US 8,597,106 B2
(45) Date of Patent: Dec. 3, 2013

(54) SAFEGUARDS AGAINST CHEATING AND MALFUNCTIONING OF GAMING DEVICES THAT USE FORMS OF CASHLESS WAGERING

(75) Inventor: Richard J. Schneider, Las Vegas, NV (US)

(73) Assignee: IGT, Reno, NV (US)

( * ) Notice: Subject to any disclaimer, the term of this patent is extended or adjusted under 35 U.S.C. 154(b) by 2011 days.

(21) Appl. No.: 10/813,910

(22) Filed: Mar. 26, 2004

(65) Prior Publication Data

US 2005/0043086 A1 Feb. 24, 2005

Related U.S. Application Data

(60) Provisional application No. 60/458,301, filed on Mar. 28, 2003.

(51) Int. Cl.
*A63F 9/00* (2006.01)
*A63F 9/24* (2006.01)

(52) U.S. Cl.
USPC ..... 463/25; 463/29; 463/42

(58) Field of Classification Search
USPC ..... 463/25, 29, 42
See application file for complete search history.

(56) References Cited

U.S. PATENT DOCUMENTS 4,283,709 A 8/1981 Lucero et al.
5,431,042 A * 7/1995 Lambert et al. ..... 73/116
5,470,079 A * 11/1995 LeStrange et al. ..... 463/25
5,496,032 A * 3/1996 Okada ..... 463/25
5,505,461 A * 4/1996 Bell et al. ..... 463/25
5,531,309 A * 7/1996 Kloss et al. ..... 194/202
5,919,091 A 7/1999 Bell et al.

(Continued)

FOREIGN PATENT DOCUMENTS

FR 2762119 10/1998
JP 10137429 A * 5/1998 ..... A63F 7/02

OTHER PUBLICATIONS

High, Robin. Dealing With 'Outliers': How to Maintain Your Data's Integrity. Computing News (University of Oregon), Spring 2000 [online], [retrieved on Jan. 21, 2008]. Retrieved from the Internet <URL:http://cc.uoregon.edu/cnews/spring2000/outliers.html>, pp. 1-4.*

International Searching Authority, International Search Report, Sep. 9, 2004.

(Continued)

*Primary Examiner* — Melba Bumgarner
*Assistant Examiner* — Frank M Leiva
(74) *Attorney, Agent, or Firm* — Foley & Lardner LLP

(57) ABSTRACT

This disclosure relates to a safeguard system on networked gaming devices. The safeguard system measures how much monetary value is output by a particular gaming device, in any form. If the gaming device has delivered an amount of value that is over a threshold amount, a warning is generated. The warning could be a visual or audio warning on a central controller, or could be an audio signal transmitted to floor personnel. Embodiments of the safeguard system include timers so that the performance of the gaming device can be independently measured over one or more time periods. The safeguard system is operable with gaming devices that accept and pay only physical currency, those that accept and pay in both physical currency and electronic methods, and those that only accept and pay by electronic methods. Some embodiments are able to remotely shut down the gaming device if the device is suspected of being cheated or malfunctioning.

52 Claims, 7 Drawing Sheets

(56) References Cited

U.S. PATENT DOCUMENTS

| | | | | |
|---|---|---|---|---|
| 6,234,900 | B1 | 5/2001 | Cumbers | |
| 6,589,119 | B1 | 7/2003 | Orus et al. | |
| 6,629,890 | B2 * | 10/2003 | Johnson | 463/25 |
| 6,749,510 | B2 * | 6/2004 | Giobbi | 463/42 |
| 2003/0060280 | A1 * | 3/2003 | Oles et al. | 463/29 |
| 2004/0033832 | A1 * | 2/2004 | Solomon | 463/25 |

OTHER PUBLICATIONS

British Examination Report dated Jan. 23, 2006, from corresponding British Application No. GB0518884.2.

PCT/USO4/009779 International Preliminary Report mailed Oct. 13, 2005.

Australia Examination Report dated Apr. 15, 2009 from corresponding AU Application No. 2004225183.

* cited by examiner

SAFEGUARDS AGAINST CHEATING AND MALFUNCTIONING OF GAMING DEVICES THAT USE FORMS OF CASHLESS WAGERING

CROSS-REFERENCE TO RELATED APPLICATIONS

This application claims priority to U.S. Provisional Patent Application Ser. No. 60/458,301, which was filed on Mar. 28, 2003.

TECHNICAL FIELD

This disclosure relates to networked gaming devices, and, more specifically, to a system for networked gaming devices that indicates when a device is malfunctioning, and prevents cheating on such devices.

BACKGROUND OF THE INVENTION

Gaming machines provide an opportunity for a user to play a variety of popular games on the machines, such as slot-type games, video adaptations of standard card games such as poker and blackjack, and many other types of games. Modern gaming machines are able to monitor gaming and other actions that occur within the machine, and forward that information over a computer network to a central system host or master controller.

An example modern gaming machine 10 is shown in FIG. 1. The gaming machine 10 includes a wager input 20 that accepts bills, tickets or vouchers at a bill slot 22, and accepts coins or tokens at a coin slot 24. The user of the machine 10 simply inserts an amount of money that he or she is willing to wager into the wager input 20, prior to playing the game on the machine 10.

A set of game electronics 15 counts the money input into the machine 10, and stores values for this and other data items in a set of internal game meters 17. The game meters 17 store information such as the amount of money wagered on the game, number of coins in, coins out, etc. In newer machines 10, an amount of credit available to the player for money inserted but not yet wagered is calculated from the stored information and displayed on a credit meter 19 viewable by the game player.

If the user wins a wager, credits are added to those already displayed on the credit meter 19. When a player decides to "cash in" the credits, or when a player wins on a machine 10 that lacks a credit meter 19, the user is paid by one of two methods. First, coins or bills could be deposited directly into a payout bin 30 by the machine 10. The coins are released from a hopper 32, which empties into the bin 30. Bills could be similarly deposited. Alternately, the user could be paid through a procedure called a "handpay".

Handpay procedures are those where a floor attendant or other casino employee pays the player directly. Generally, there are three scenarios when handpays are used: when the player wins a "jackpot", which is a single win over a threshold amount; when a player cashes out a number of credits above a cashout threshold amount, or when the hopper 32 of the machine 10 does not contain enough money to pay the player. When any of these situations occur, the machine 10 automatically locks up and an attendant is dispatched to the machine. The attendant then verifies the amount to be paid, pays the player, and unlocks the machine.

The wager input 20 and hopper 32 are in communication with, report to, and are controlled by the game electronics 15.

The game electronics 15 is in turn coupled to a communication module, such as a bonus engine 14. The bonus engine 14 is connected to a data connector cable 12, which in turn is coupled to a game network. The bonus engine 14 interfaces with data collectors and information sensors that are located throughout the machine 10 through the game electronics 15, and sends the collected information to the data connector cable 12 for further delivery to a central system on the game network (not shown).

There are some existing, limited, safeguard mechanisms used in modern gaming devices to protect against game machines malfunctioning and paying out money in error, or being deliberately cheated to pay out unearned money. Generally these existing safeguards rely on the fact that there are only two ways money can be paid out from a gaming machine 10, i.e., via the hopper 32 or via the handpay. Current safeguard systems typically monitor the number of times the hopper 32 is refilled in a set time period. If the number of times the hopper 32 is refilled within this period exceeds a pre-set maximum, then the safeguard system prints a report or otherwise generates a warning to notify a floor manager or other casino personnel that the gaming machine 10 should be investigated. In current safeguard systems, handpays are usually ignored and not considered at the time they are paid, although they may be considered at a later time, e.g., at the end of day processing. Thus, a malfunctioning device or a device being cheated may not be recognized as such for some time.

These present safeguard systems are also ineffective for a number of other reasons. Even with modern gaming devices there are cheats and failure modes that can cause the device to pay more money than it is supposed to pay. For example, coin or paper detection mechanisms in the wager input 20 can fail, or can be purposefully cheated such that inserting one coin or bill results in multiple coin or bill credits to the device 10. Coin detection mechanisms in the coin hopper 32 can fail so that multiple coins come out when only one coin is signaled to the game electronics. The result is overpayment to the user. These types of problems are difficult to detect with present methods.

Another problem exists in that newer gaming devices are migrating toward cashless operation. Rather than accept and pay out wagers in bills, coins, or tokens, new machines are experimenting with accepting and paying wagers in tickets, cards, or other vouchers, or even using forms of electronic methods for payment and credit. Therefore, safeguard mechanisms that simply monitor hopper fills are not sufficient for these devices. In fact, future gaming devices may not even include a hopper for wager payout.

Embodiments of the invention address these and other deficiencies in the prior art.

SUMMARY

In one aspect, the invention features a gaming system. The gaming system includes a gaming device containing a game to be played by a user. A value tracker is structured to track an amount of monetary value accepted into the gaming device and to track an amount of monetary value output from the gaming device. A warning generating system is structured to generate a warning signal based on the amounts tracked by the value tracker.

In another aspect, the invention features a gaming device that includes a set of game electronics structured to monitor events of the gaming device. The gaming device includes an input accounter structured to record transactions of monetary value accepted into a gaming device during a time period. An output accounter is structured to record transactions of monetary value generated by the gaming device for the benefit of the game user during the time period. A warning calculator is coupled to the input accounter and the output accounter. The warning calculator is structured to generate a payout warning signal based on the recorded transactions. A data transmitter is coupled to the warning calculator, and it is structured to transmit the warning signal over a communications network coupled to the gaming device.

In yet another aspect, the invention features a method of providing an accounting safeguard on a network gaming device. The method includes recording an amount of monetary value paid by the gaming device and comparing the amount of monetary paid by the gaming device to one or more predetermined values. A warning is issued if the amount of monetary value paid by the gaming device exceeds the one or more predetermined values.

BRIEF DESCRIPTION OF THE DRAWINGS

The description may be best understood by reading the disclosure with reference to the accompanying drawings.

DETAILED DESCRIPTION OF THE PREFERRED EMBODIMENTS

Figure 1:
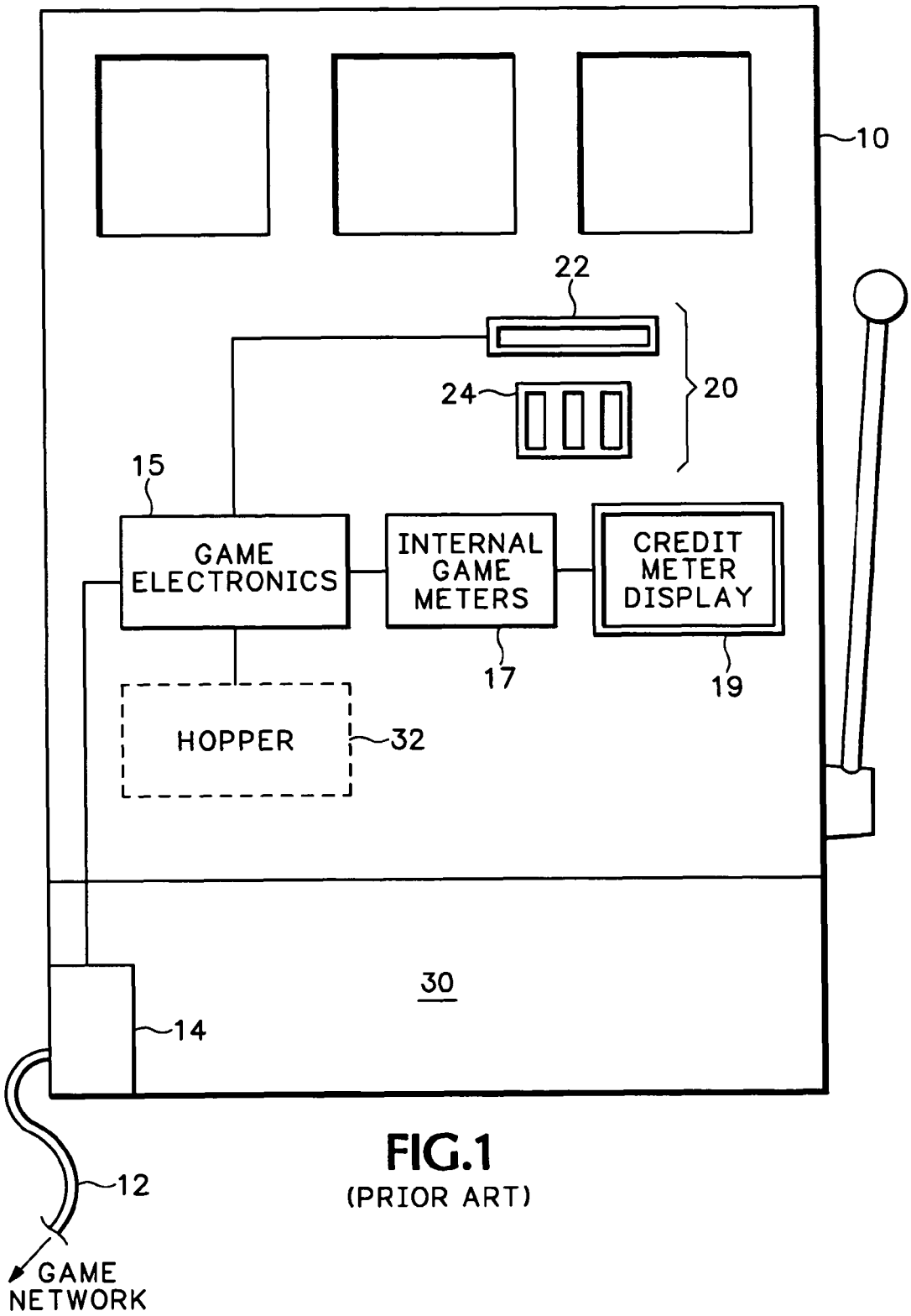
FIG.1 (PRIOR ART)
FIG. 1 is a diagram showing a present gaming device and ways in which it can accept payment and pay wagers.

Embodiments of the invention include a gaming system with safeguards that monitor the payment history of the device and warn if the device is outside of established payment parameters. Data gathered by the gaming system includes, among other data, all money or monetary value input into the system and all money or monetary value generated by the system, no matter the form. Inputs or items considered as money or having monetary value include, inter alia, all currency, legal tender, tokens, tickets, vouchers, coupons, electronic credits, account transfers, etc. accepted at inputs to the device for game play and/or wager. Generated outputs considered as money or having monetary value include, inter alia, payments in the form of currency, legal tender, tokens, tickets, vouchers, coupons, handpays, electronic credits, account transfers, etc. Additionally, the gaming system gathers information about how many games have been played, the total amount wagered for a game, the total winnings on games played, etc. Primarily, embodiments of this invention concern the total amount of monetary value entered into the gaming device, in whatever form, and the total amount of monetary value benefit delivered to the player/players of the device, in whatever form.

In embodiments of the invention, a warning or indication is generated when the total amount of monetary value benefit delivered to the users of the gaming device exceeds a predetermined threshold amount. Other embodiments allow other data to be considered or not considered in the benefit calculation. For instance, it may be desired that any jackpots paid by the gaming device not be considered as part of the benefit calculations, because jackpots or other large payouts can skew the average amount of payout from a machine. It may also be desired to subtract any monetary value entered into the gaming device from the output benefit calculations and track only the amount of value paid by the gaming device in excess to that input to the gaming device, because paying out large amounts may not necessarily warrant a warning if the device is also collecting a large amount of monetary value from the user.

As described above, there are many ways a gaming device can accept payment for play. Payment can be in legal tender (i.e., coins and bills produced and distributed by a government), coin-shaped or other tokens, tickets made from a substrate such as paper or plastic, vouchers, coupons, etc. Gaming devices can also accept cards or chips that can be read at an electronic input, such as a card having a magnetic strip and smart cards having pre-programmed memory chips attached to them.

Electronic inputs can be classified into one of two broad categories: those that have monetary value placed directly on the object or card, and those that store account identifying information linked to a user that has monetary value therein. For instance, a user may buy a card at a ticket window having $40.00 of value. This value amount is coded and stored in the card's magnetic strip or in a memory device attached to the card. The memory device could be a semiconductor flash memory or other ROM memory. As the user plays games and wagers amounts on the device, the gaming device can automatically debit the card and re-write the new credit/amount value to the card. Another method would be for the game to only re-write the new value to the card when the card is being removed from the gaming device. Such a method would save time and wear on the components of the game necessary to write the new data.

The other type of electronic input has codes on the strip or in the chip to identify a user or an account associated with the user. The card or chip could be inserted into a reader in the gaming device, or could even be read wirelessly, simply by holding the card or chip near a reader contained within the device. The account associated with the card or chip can be a special casino account pre-loaded with an amount of money, for instance, by depositing $100.00 into the casino account or by transferring winnings from a previously played game. Or, the account could be a standard credit account issued by a bank. Then, once the user has completed playing the game for the present session, the amount to be debited from the account can be sent to the master controller for immediate or later debit from the player's account.

Figure 2:
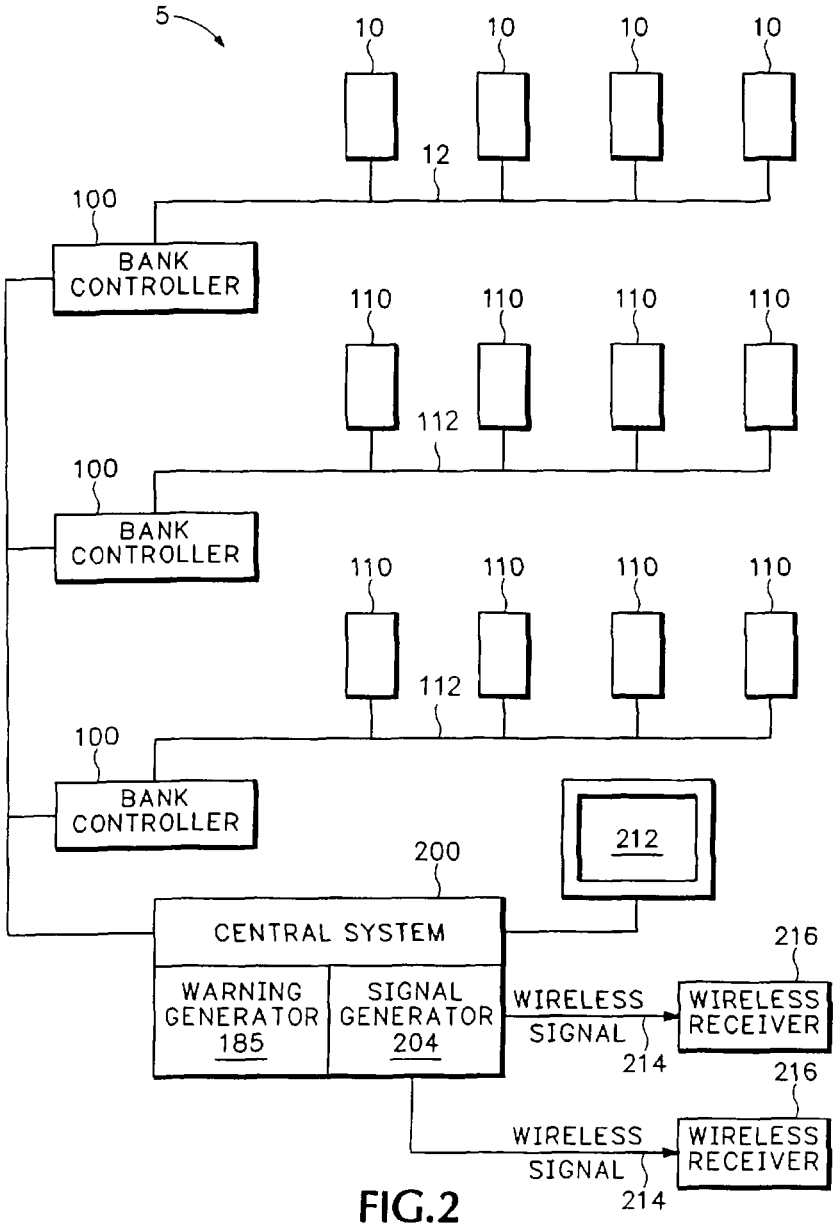
FIG. 2 is a block diagram showing a network of gaming devices.

As mentioned above, modern gaming machines are typically networked so that they can be monitored and/or controlled from a local or a central server. An example of a networked gaming system 5 is shown in FIG. 2. That figure shows several gaming devices 10 that are coupled through data connector cables 12 to a bank controller 100. Multiple bank controllers 100 are coupled together and to a central system 200. A display 212 or other output devices such as wireless receivers 216 coupled to the central system 200 deliver messages from the central system to an operator or other casino personnel.

Figure 3:
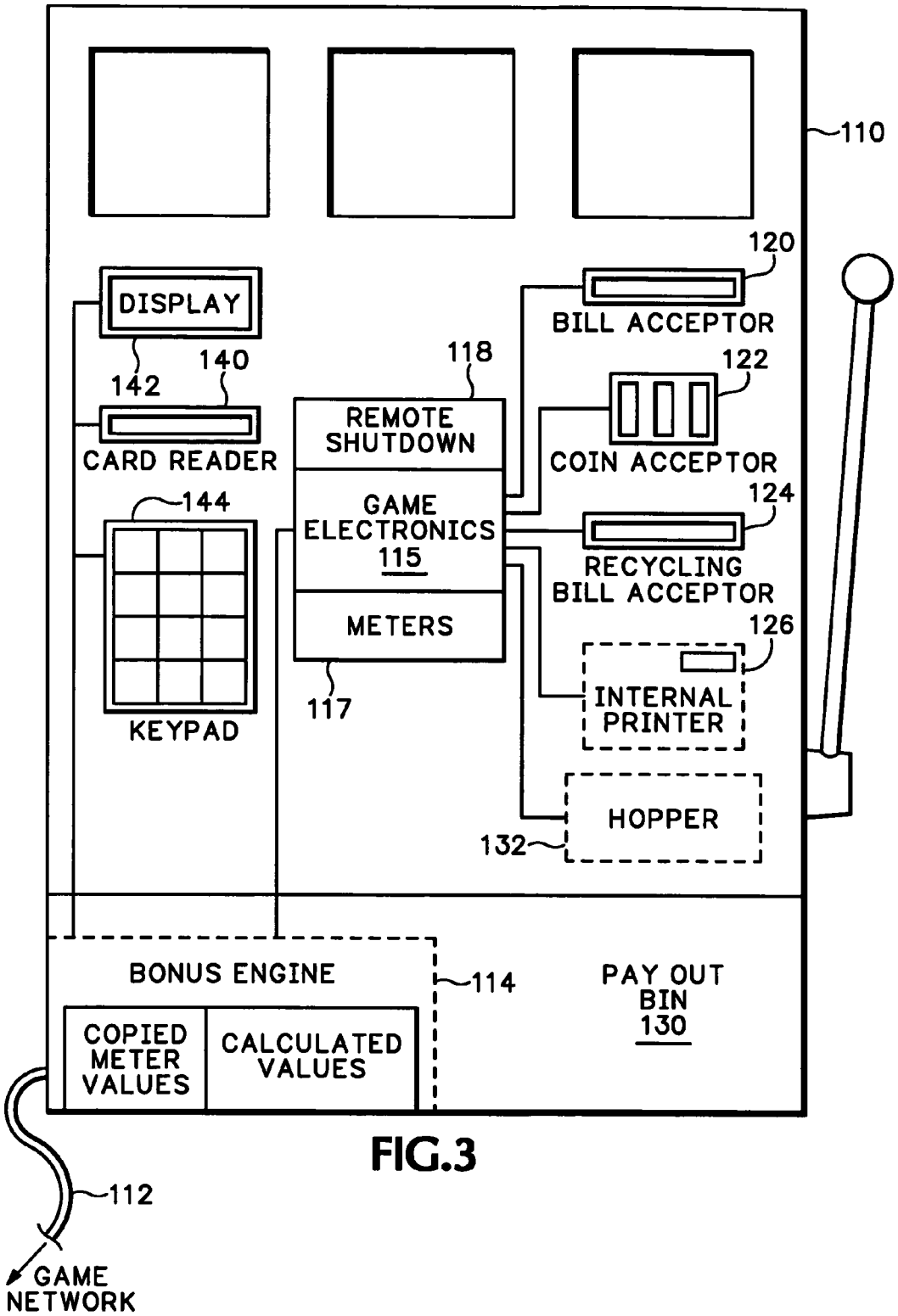
FIG. 3 is a diagram showing a gaming device including a safeguard system according to embodiments of the invention.

A game device portion of a gaming system according to embodiments of the invention is shown in FIG. 3. A game device 110 is similar in many ways to the machine 10 of FIG. 1. For instance, the game device 110 includes a data communication cable 112 coupled to a communication module, which is shown as a bonus engine 114. Data collected from various data inputs from the device 110 is collected by the bonus engine 114 and sent over the data communication cable 112 to a central system 200 (FIG. 2), as discussed in detail below.

The gaming system 5 of FIG. 2 can include both known-type gaming machines 10, as well as the game devices 110 according to embodiments of the invention. Game devices 10, 110, and others can be connected to the central system 200 through the same gaming system 5, regardless of the different components of the gaming devices.

Referring back to FIG. 3, the game device 110 includes several inputs and outputs that are managed either by the bonus engine 114 or a set of game electronics 115, or a combination of the two.

The set of game electronics 115 manages ways to physically input monetary value into the game device 110, and ways that the game device physically outputs monetary value to the player. For instance, the game device 110 may include a bill acceptor 120 that can accept bills, tickets and vouchers, as well as a coin acceptor 122 that can accept coins or tokens. Additionally, the game device 110 may include a recycling bill acceptor 124 that not only accepts bills, but also can classify them according to denomination and use the same bills that were input into the device 110 to pay a winning player of the device. An internal printer 126 can print tickets, vouchers, and/or coupons, for example and distribute them to the player, for example when he or she cashes out from playing the game device 110, or at other times. A hopper 132, similar to the hopper 32 of FIG. 1, stores coins or tokens to be distributed to the player through a payout bin 130 when he or she wins or cashes out credits from the game device 110.

Each of the bill acceptor 120, the coin acceptor 122, the recycling bill acceptor 124, the printer 126, and the hopper 132 are coupled to and controlled by the game electronics 115. The game electronics 115 counts all of the monetary value entered into the game by bills, coins, tokens, tickets, vouchers, etc. and stores those amounts in a set of game meters 117, which are connected to the game electronics 115. Similarly, the game electronics 115 tracks and records in the meters 117 payments made from the game device 110 by the recycling bill acceptor 124, coupons or vouchers printed by the printer 126, and coins or tokens paid through the hopper 132. The meters 117 also record payments made by hand pays, e.g., handpaid jackpots and credit cashouts.

The game electronics 115 also manages the game played on the game device 110, such as which game is being played, how much is wagered, and the winnings generated by playing the game. Some game devices 110 include a remote shutdown 118, coupled to the game electronics 115, which allows the bonus engine 114 or the central server 200 to send a signal to have the game device 110 locked or shutdown. This feature is important to allow the safeguard system to shut down a suspect game device 110 as soon as practical after a payment anomaly is identified.

In addition to the physical ways to enter money into and receive money from a gaming device, modern gaming devices 110 include one or more methods for accepting electronic indications of value for the device. A card reader 140 could include a magnetic strip reader, a bar code reader, or a chip reader that reads information contained on a card or other object inserted into an electronic port. A display 142 and a keypad 144 allow a player to enter a PIN code or other identifying information. The display 142 can also be used to deliver messages to and interact with the player. The bonus engine 114 is the primary interface controller of the card reader 140, display 142 and the keypad 144. Information read from the object placed in the card reader 140 could have monetary value itself, or could be account access information that could be used to identify and access the player's account. Another way to access account information would be to enter a card in the card reader 140 and then enter a PIN code in the keypad 144. The account information thus identified could be relayed through the bonus engine 114 to the central system 200, which in turn is coupled to the account information.

The bonus engine 114 is coupled to the game electronics 115 and the two systems are in constant communication. The bonus engine 114 receives constant status updates about the state and status of the game device 110. The game electronics 115 may automatically send information to the bonus engine 114, such as "events", when the events occur, such as at the end of the game, or when a key event happens like a coin accepted into the game device 110. Or, the bonus engine 114 may send electronic updates, requests, or polls to the game electronics 115. When polled, the game electronics 115 sends the latest events to the bonus engine. Additionally, the bonus engine 114 may request that the information stored in the game meters 117 be sent to the bonus engine.

As discussed below, the bonus engine 114 may store the information used from the game electronics 115, may perform calculations on the information and store the calculated values in the bonus engine, and may send either the stored or calculated information, or both, to the central system 200.

Figure 4:
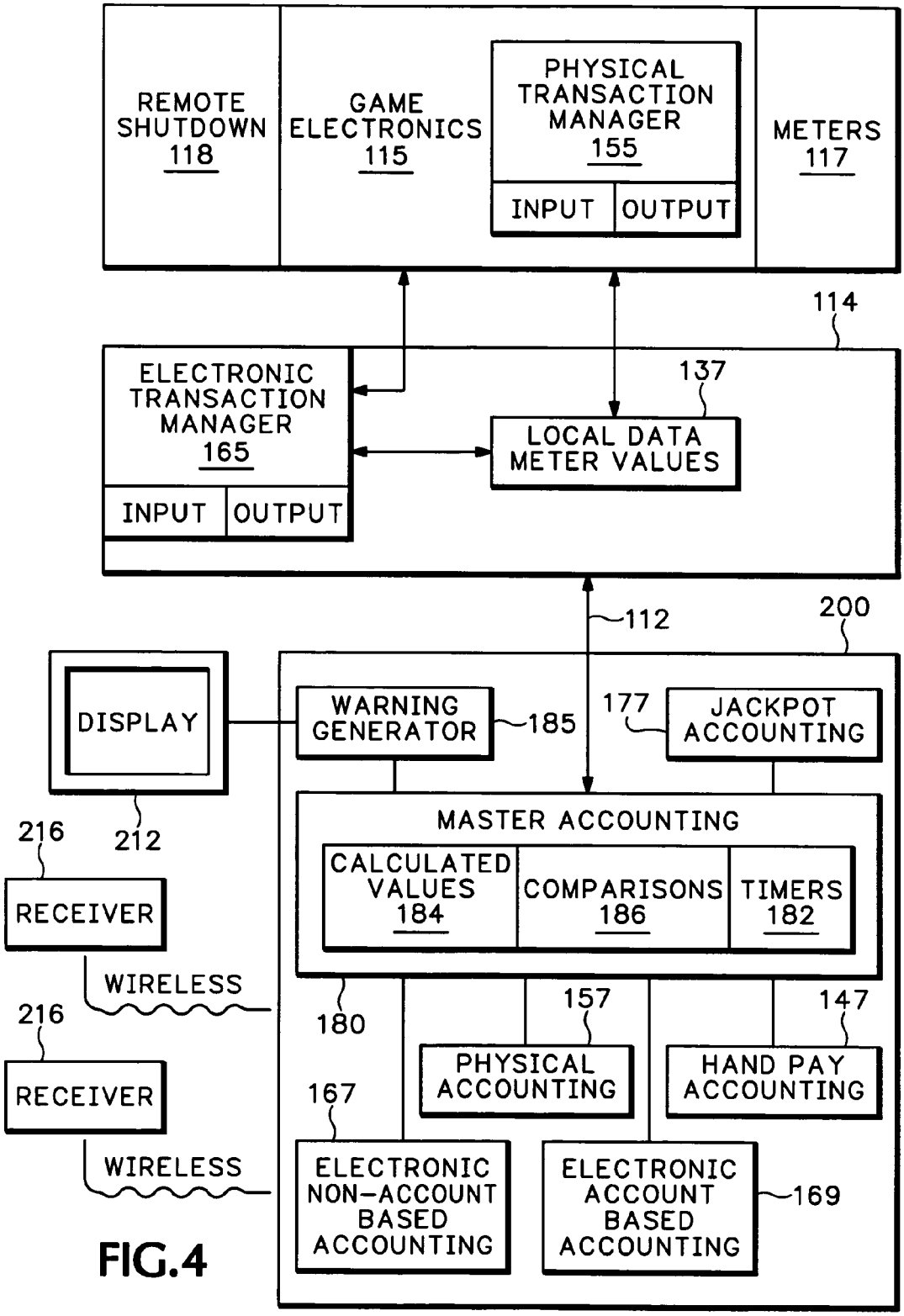
FIG. 4 is a functional block diagram showing processes and functions used with the gaming device of FIG. 3.

A functional block diagram illustrating processes that can be present within the safeguards against cheating system is shown in FIG. 4. These illustrated functions may be implemented in any way, such as hardware, software, firmware, etc. or a combination of those implementations. Similarly, the functions could be procedures running on a general purpose or specialty microprocessor.

Figure 5:
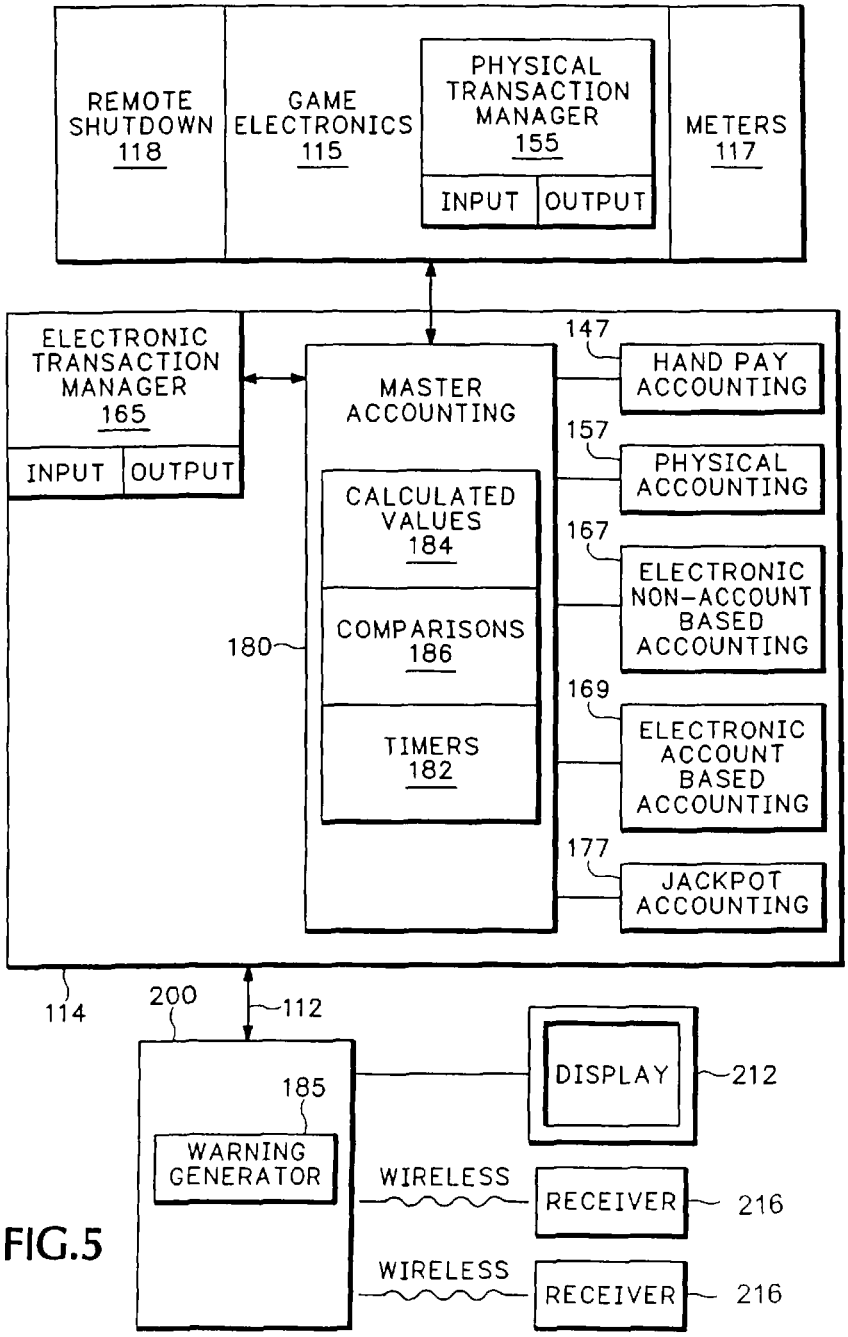
FIG. 5 is a functional block diagram showing processes and functions used with the gaming device of FIG. 3.

In FIG. 4, the processes illustrated are performed mostly in the central server 200, while the bonus engine 114 plays a minimum role. In FIG. 5, conversely, the processes are mostly performed in the bonus engine 114 while the central server 200 plays a minimum role in the safeguard system. It is unimportant where the processes are actually performed in the system, they can be performed in the bonus engine 114, or the central server 200, or a combination of the two. Additionally, the processes could be implemented to be performed in the game electronics 115 of the game device 110, or in the bank controller 100 pictured in FIG. 2, if desired. Implementing these embodiments involves similar considerations, no matter where the functions are ultimately performed.

FIG. 4 shows a physical transaction manager 155 coupled to or within the game electronics 115. In most embodiments, functions of the physical transaction manager 155 will be performed by the game electronics 115 itself. The physical transaction manager 155 is coupled to the physical payment mechanisms mentioned with reference to FIG. 3, i.e., the bill acceptor 120, coin acceptor 122, etc. The physical transaction manager 155 monitors the inputs of the bill acceptor 120 and the coin acceptor 122, monitors the inputs and outputs from the recycling bill acceptor 124, and monitors the outputs from the printer 126 and from the hopper 132. Transactions using any of these sources are stored in the game meters 117 for use by the game electronics 115, bonus engine 114, and central server 200.

Also included in FIG. 4 is an electronic transactions manager 165, which, as described above, can be part of the bonus engine 114. The electronic transactions manager 165 manages the electronic inputs and outputs from the game device 110, such as the card reader 140, the display 142 and the keypad 144. These inputs and outputs would include management functions for the all of the input and output transactions involving magnetic strip cards, bar coded cards, smart cards, account transactions, etc. for the game device 110. For example, the amounts of monetary value wagered by or paid to a player through the player's account would be handled by the electronic transactions manager 165, and stored in the game meters 117.

Both the physical transaction manager 155 and the electronic manager 165, by virtue of being coupled to or contained within the bonus engine 114, communicate with the central server 200 via the data cable 112. Therefore, any of the transactions registered by either of the transaction managers 155, 165 can be sent to the central server 200 for processing.

The bonus engine 114 may also include a set of local data meters 137 that can store a local copy of the data contained in the game meters 117, or data modified by the bonus engine 114.

As shown in FIG. 4, the central server 200 includes a master accounting function 180, which is a central process of which one function is to track all possible inputs and outputs to the game device 110. Within the master accounting function 180 are storage areas 184 for values calculated by the accounting function or by the bonus engine 114. Additionally, the master accounting function 180 includes a set of comparators 186 used to compare calculated and other values to pre-determined static values. For instance, the data comparators 186 may compare the current accounting data to stored values that would indicate the game device 110 is malfunctioning or being cheated.

Coupled to the master accounting function 180 are a series of other accounting functions, generally used to track a particular type of input/output. Examples of the coupled accounting functions are a physical accounting function 157, an electronic non-player account based accounting function 167, an electronic player account based accounting function 169, a handpay accounting function 147, and a jackpot accounting function 177. Of course other accounting functions could be present within the central server 200 and coupled to the master accounting function 180.

The physical accounting function 157 accounts for actions managed by the physical transaction manager 155. It measures monetary value transactions in the game device 110 that occur by physical objects being input or delivered, such as coins, bills, tokens, coupons, vouchers, etc. entered for game play and/or wager, as well as coins, bills, tokens, coupons, vouchers, etc. paid by the game device to the player.

Two accounting functions account for actions managed by the electronic transaction manager 165. They are the electric non-player account based accounting function 167, and the electric player account based accounting function 169. The non-account based function 167 can account for the electronic transactions that take place immediately within the game device 110. For instance, if a card input at the card reader 140 had a pre-purchased amount recorded in a magnetic strip, or an amount "stored" on a previously printed ticket that is being redeemed, the non-player account based accounting function 167 can account for all the credits or amounts received from and/or delivered to the card. The player account based function 169, conversely, tracks and manages all of the account transactions associated with a player's account. For instance, the electronic transaction manager 165 first reads the account information from a card or chip placed in the card reader 140, or input from the keypad 144. Then the player account based accounting function 169 verifies that the account is authentic, and it tracks monetary amounts transferred from the player's account to the game device 110 for play/wager. Any winnings by the player are similarly recorded for later deposit into the player's account by the account based accounting function 169. Both the electronic accounting functions 167, 169 are also coupled to and share data with the master accounting function 180, and can also communicate with the bonus engine 114 and the game electronics 115. Of course, both the electronic accounting functions 167, 169 could be implemented together in a single device or process, and are only shown separately in FIG. 4 for ease of explanation. In other embodiments, only a single accounting function is present, which can singly perform all of the accounting functions described above.

The central system 200 also includes the handpay accounting function 147. The handpay accounting function 147 tracks handpay transactions on the game device 110, such as jackpot payouts, credit payouts that are above a pre-set limit, and payouts that are made by hand when the hopper 132 is low or empty. The game electronics 115 stores these amounts in the game meters 117 or stores and indication that particular amounts were hand paid, so that the handpay accounting function 147 can calculate them. The bonus engine 114 may also store an additional copy.

The jackpot accounting function 177 is also coupled to the master accounting function 180. The jackpot accounting function 177 specifically tracks which of the payouts via a handpay, the physical transaction manager 155, and the electronic transaction manager 165 are for a jackpot amount. Jackpot amounts, in some embodiments of the invention, are specifically withheld from some calculations, in order to prevent them from skewing averages used to determine whether to indicate that a particular machine may be malfunctioning.

As described above, all of the accounting functions may be implemented in a single accounting system, and not specifically broken out into components.

The master accounting function 180 may include a set of local timers 182 that can be locally reset. The timers 182 allow the master accounting function 180 to track usage of the game device 110 in a number of different timeframes. For instance, one timer may be reset every minute, while another one reset every hour. Still others could be reset daily or monthly. Because some or all of the game meters 117 coupled to the game electronics 115 are incapable of being reset, the lifetime performance of the game device 110 can be reviewed by the accounting function 180 as required.

Using timers 182 that are reset at different intervals allows the safeguard system to guard against almost any type of theft from or malfunction of the game device 110. For instance, having a time that is reset every minute ensures that an amount of money paid out from the game device 110 can be checked every minute, such that a large jackpot can be investigated immediately when it occurs. Having timers 182 of other duration, however, allows the safeguard system to warn that a player may be cashing out multiple small amounts from the game device over a long time. Previous systems would not catch this type of fraud until the end of a shift or the end of the day, while embodiments of the inventive safeguard system would detect this problem as it was occurring. For example, if a pre-set handpay limit were $300, and the player was playing on a cheated machine that paid well above the normal payout schedule, the player could cashout every time the player accumulated $250 in credits. If the player were cashing out by receiving tickets, or by an account transfer, the hopper 132 would not run out of money. Therefore, unless the game device is protected by a safeguard system like the one described herein, the player could steal well above the threshold limit prior to the time the machine was audited during normal procedures, for instance at a shift change or at the end of day. By comparing the amount being paid out from the machine against pre-set limits of when the game may be malfunctioning, the safeguard system can cause the game device 110 to be investigated much earlier than previously possible.

Also included within the central system 200 is a warning generator 185 that is coupled to the master accounting function 180. When the master accounting function 180 determines that there is a potential that a particular game device 110 is being cheated, or is malfunctioning for any reason, the warning generator 185 operates to generate a warning signal to alert casino personnel. The warning signal can be implemented in a number of ways. For instance, the warning signal may include placing the machine number on a printout list of machines to watch. Or, the warning signal may be more immediate, such as an indication on the display 212 coupled to the central system 200, or an audio signal, such as a page or a radio signal sent to one or more wireless receivers 216.

FIG. 5 is a functional block diagram that illustrates that it is unimportant where particular functions and processes in the safeguard system are hosted. Whereas in FIG. 4, most of the processes in the safeguard system were hosted in the central system 200, the processes could also be implemented in the bonus engine 114, or even in the game electronics.

In this embodiment, the master accounting function 180 operates in the same way, and uses the same accounting functions to determine when a warning should be generated. The warning may be generated from the bonus engine 114 itself, or a signal indicating that a warning should be generated is then passed over the data connection cable 112 to the central system 200. The warning generator 185 then generates the appropriate warning signal.

Figure 6:
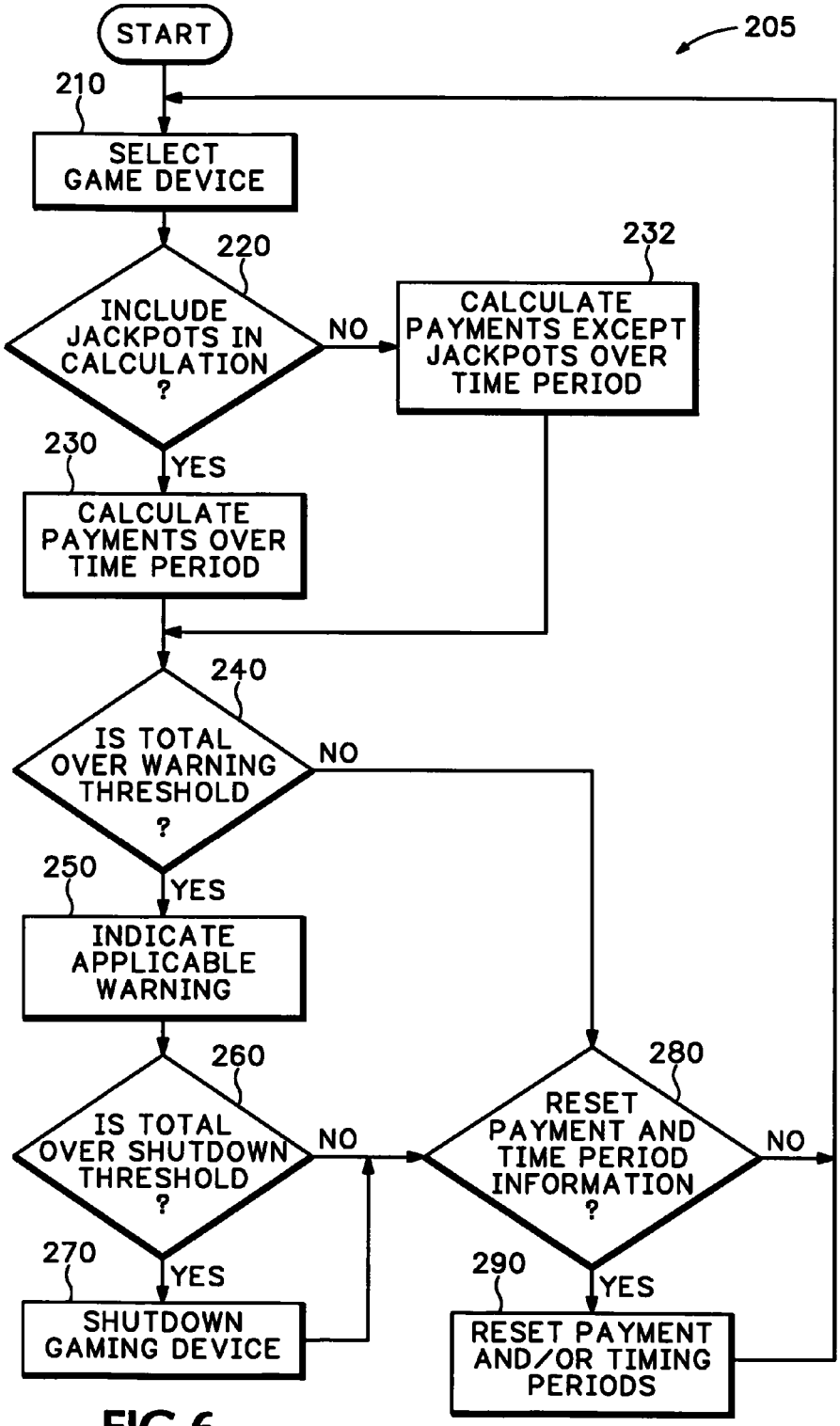
FIG. 6 is a flow diagram showing an example flow that can be used in conjunction with embodiments of the invention.

FIG. 6 is an example flow diagram of a safeguard process 205 that can be utilized to monitor account performance of the game device 110. The safeguard process 205 may be implemented to run on the central system 200, the bonus engine 114 itself, the game electronics 115, or some combination thereof.

The safeguard process 205 begins at process 210 where a particular game device 110 is selected from any of the devices connected to the central system 200 (FIG. 2). When the process 205 is running on the game electronics 115 or on the bonus engine 114 coupled to a game, most likely the game selected in process 210 will be the game device 110 to which the bonus engine is attached. A decision 220 is evaluated to determine if jackpots are to be considered in the calculations. If so (YES), then a process 230 calculates a total of monetary value paid out to the player by the gaming device, in any form, over a time period. For instance, the process 230 totals all payments made by the handpay data recorder 145, the physical manager 155 and the electronic manager 165, and, in some embodiments, divides the total payment amounts by one or more time periods to yield payment per time numbers.

Thus, the total monetary value included in the process 230 may include cashout or other tickets generated by the device, credits or cash equivalents transferred into a player account or to a physical device, such as a card or a smartcard, currency delivered to the player in the form of coins, bills, tokens, coupons, etc., jackpots, handpays, bonus transfers, and transfers from progressive payout awards, etc.

If decision 220 exits in the negative (NO), the process 232 performs the same procedure as did the process 230, but the jackpots are withheld from the total payment calculations using the jackpot accounting function 177. Either process 230 or 232 yields one or more payment numbers or payment per time numbers.

In decision 240, the total payment numbers are compared to one or more pre-defined warning thresholds. This could be performed in the master accounting function 180 by comparing calculated values stored in the storage locations 184 to the pre-defined thresholds stored in the comparators 186. The thresholds could be modified over time to balance the protection provided by the safeguard system with the number of false alarms generated. For instance, the thresholds could be increased by $1000 for every hour of play. Modifying the threshold values involves storing new comparison values in the comparators 186 of the master accounting function 180. Modifying the threshold values could be dynamic as well, and can include how much monetary value has been entered into or has been used by the gaming device. Or, the threshold could include how much monetary value has been entered into or has been used by the gaming device, plus an additional amount—to decrease the chance of a false alarm if a player's winnings exceed what the player has put into the gaming device.

If the amount calculated in process 230 or 232 exceeds any of the pre-defined warning thresholds, a proper warning is indicated by the warning generator 185 in a process 250. For instance, there may be three pre-defined warning thresholds for each of the relevant time periods. If the amount calculated in process 230 or 232 is below the lowest threshold, then no warnings are given. If the amount exceeds a first threshold, a first warning is shown on the display screen 212 that is attached to the central system 200, such as a particular color or icon. Or, a first warning may be to place the particular game device 110 on a watch list or event log that can be printed and posted, or checked at a shift change. Another possibility is an audible beep or other noise is generated by a warning signal generator 185, or generated at the bank controller 100 to which the game device 110 is connected. Exceeding the other warning threshold levels could result in larger visible warnings, larger icons, different colors, and louder audible warnings, for instance. Another possibility is that the warning could take the form of a numeric page sent to a pager worn by a casino floor attendant. The numeric page could identify which machine is generating the warnings. Still further, one of the warnings could be an automated message transmitted over a wireless communication network 214 (FIG. 2), such as a radio frequency network for the casino, where floor attendants each wear a radio headset or receiver 216 tuned to the specific frequency. The wireless communication network 214 and receiver or receivers 216 can take any form. The warnings generated in the process 250 can be continuous warnings, where they are repeated until some sort of action is taken by an operator, or they could occur only a few times or even one time. In the case of a warning generator 185 that generates continuous warnings, there should be included a way to remove a game device 110 from the continuous warning after the device is checked and, if necessary, fixed. Such a system could include having a supervisor log on to the system 200 (FIG. 2) and remove the particular game device 110 from the warning list.

Results of the processes 230 and 232 can be calculated for more than one time period during these processes, and each of the results compared to the warning thresholds in the decision 240. For example, the decision 240 can compare warning thresholds of payments over the last few seconds, minute, hour, day, week, month, and/or year, and generate their appropriate warnings in the process 250.

In some embodiments, another check is made at a decision 260 to see if the total calculated in processes 230, 232 exceeds a pre-determined shutdown threshold. Exceeding this threshold indicates that something may be seriously wrong with the game device 110 and should be shut down immediately in process 270. Shutting down the game device 110 is performed by sending an appropriate signal to the remote shutdown portion 118 of the game electronics 115 in the particular game device to be shut down. This shuts down the game device 110 so that no further play can continue, until the device is reset. Of course, the central system 200 or bonus engine 114 can still receive data from the game device 110 so that locating the problem in the device can proceed by running operations from the central system. There may be other ways to track down the problem with the game device 110, such as by performing operations directly on the device by a casino employee or game technician.

A decision 280 checks to see if any of the timers or accounting data stored in the master account controller 180 should be reset. If yes, then process 290 resets any desired timers 182 or accounting information locally stored in the calculated values 184 or comparators 186 of the master accounting function 180 by sending appropriate signals.

Once these processes are complete, the safeguard process 205 repeats by selecting the same or another of the game devices 110. Of course, not all of the processes or decisions in the safeguard process 205 need be present in all embodiments of the invention. For instance, not all safeguard processes need to question whether to exclude jackpots from their calculations. Also, some embodiments of the game device 110 may not include the remote shutdown portion 118 of the game electronics 115, and consequently decision 260 and process 270 can be eliminated for those devices.

Figure 7:
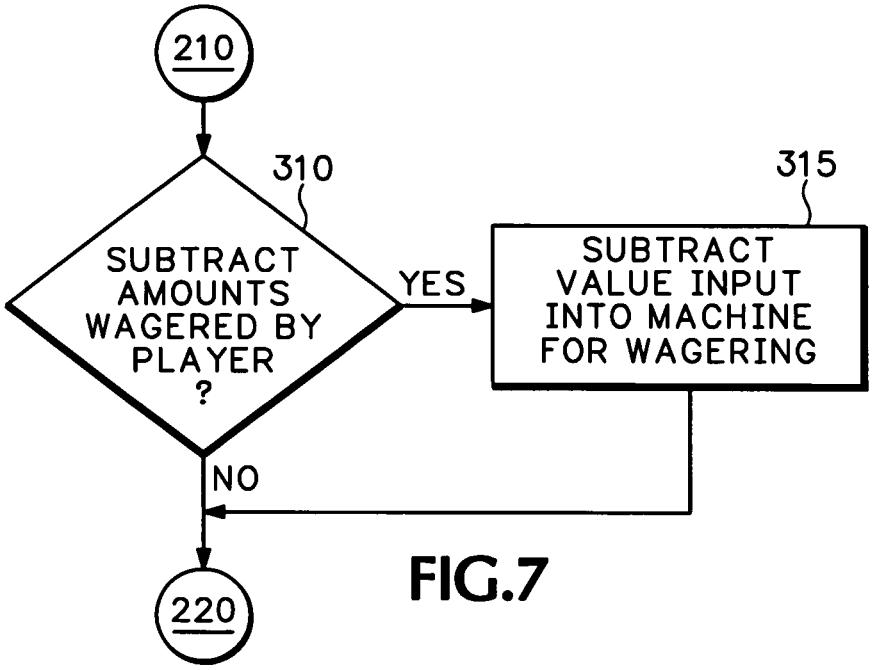
FIG. 7 is a flow diagram showing a portion of another example flow that can be used in conjunction with embodiments of the invention.

FIG. 7 shows an additional process that can be included in still other embodiments of the invention. In those embodiments, after the game device 110 is selected in process 210, a decision 310 queries if monetary values that have been input into the game device 110 should be subtracted in a process 315 prior to the comparison 240 of FIG. 5. Including this process 315 prevents false warning signals where the game device 110 has paid out large amounts of winnings, but the player of the game device had also input a large amount of fees/wagers.

By generating warnings when gaming devices are paying out large amounts of monetary value, the rate of purposefully cheating and/or malfunctioning gaming machines can be greatly minimized. Including automatic shutdown when the payout values are excessive could prevent the gaming device from paying out excessively for a long time prior to being noticed by casino operators or the machine's owners. By creating a monitoring system that monitors all types of monetary payments into and from a gaming device, casino managers can easily manage a larger number of games using fewer personnel, with greater oversight capabilities.

Although examples of machines and processes have been described herein, nothing prevents embodiments of this invention from working with other types of machines and processes. Implementation of the gaming devices and safeguard system is straightforward in light of the above description. As always, implementation details are left to the system designer. The specific circuits and procedures used to account for input and outflow of the monetary value from the gaming device may be implemented in any way, with any components, so long as they can track the real-time or near real-time accountings of the device. Specifically, although functions are performed in a system including a gaming device and a central controller, the functions can be performed on either the gaming device, or the controller, or some functions performed on both the gaming device and the controller, depending on how the system is implemented. Inclusion of description or illustration of a function in either the gaming device or the central controller is not dispositive that the function is located in or must be performed there. The safeguard system works even when not all of the accounting functions are present or necessary. For instance, in a cashless form of a gaming device, the physical accounting function may not be necessary, but this and other similar embodiments are specifically contemplated as embodiments of the invention.

Thus, although particular embodiments for a safeguard warning system including active accounting information procedures have been discussed, it is not intended that such specific references be considered as limitations upon the scope of this invention, but rather the scope is determined by the following claims and their equivalents.

What is claimed is:

1. A gaming system, comprising:

a gaming device containing a game to be played by a user;

a value tracker structured to track an amount of monetary value accepted into the gaming device, and to track an amount of monetary value output from the gaming device; and a warning generating system coupled to the value tracker configured to generate a warning signal based on a comparison of the monetary value accepted into the gaming device and the monetary value output from the gaming device for predetermined time periods of different durations wherein each time period has an associated warning threshold wherein the warning threshold is a function of the duration of the time period with which it is associated, wherein the warning generating system includes a jackpot accounting system configured to determine jackpot payouts by tracking individual amounts of monetary value output from the gaming device that are for a jackpot amount, wherein the warning generating system is configured to exclude the jackpot payouts determined by the jackpot accounting system to thereby prevent an unwarranted payout warning signal, and wherein a warning signal is generated when the comparison indicates that a warning threshold for a time period is exceeded.

2. The gaming system of claim 1 wherein the value tracker is structured to track an amount of monetary value accepted into the gaming device by one or more of: currency, bills, or tokens deposited into the gaming device, credits or cash equivalents transferred to the gaming device, coupons or tickets redeemed by the gaming device or redeemed elsewhere on a gaming network to which the gaming device is coupled, and transfers of bonus, payout or other awards to the gaming device.

3. The gaming system of claim 2 wherein the value tracker is structured to track credits or cash equivalents transferred to the gaming device from a gaming network to which the gaming device is coupled.

4. The gaming system of claim 2 wherein the value tracker is structured to track credits or cash equivalents transferred to the gaming device from a player account.

5. The gaming system of claim 2 wherein the value tracker is structured to track credits or cash equivalents transferred to the gaming device from a physical device.

6. The gaming system of claim 5 wherein the physical device is one or more selected from the group of a card, a smartcard, a coupon, and a ticket.

7. The gaming system of claim 1 wherein the value tracker is structured to track an amount of monetary value output from the gaming device by one or more of: currency, bills, or tokens physically discharged from the gaming device, credits or cash equivalents transferred from the gaming device, coupons or tickets generated by the gaming device or generated elsewhere on a computer network to which the gaming device is coupled, handpays generated in response to gaming device commands, and transfers of bonus, payout or other awards to the user of the gaming device.

8. The gaming system of claim 7 wherein the value tracker is structured to track credits or cash equivalents transferred from the gaming device to a gaming network to which the gaming device is coupled.

9. The gaming system of claim 7 wherein the value tracker is structured to track credits or cash equivalents transferred from the gaming device to a player account.

10. The gaming system of claim 7 wherein the value tracker is structured to track credits or cash equivalents transferred from the gaming device to a physical device.

11. The gaming system of claim 10 wherein the physical device is one or more selected from the group of a card, a smartcard, a coupon, and a ticket.

12. The gaming system of claim 7 wherein the value tracker is structured to track jackpots.

13. The gaming system of claim 1 wherein a time period is resettable.

14. The gaming system of claim 1 wherein the time periods can operate concurrently.

15. The gaming system of claim 1 wherein a time period is one hour.

16. The gaming system of claim 1 wherein a time period equals a duration of a casino employee work shift.

17. The gaming system of claim 1 wherein the value tracker is structured to track the amount of monetary value accepted into the gaming device, and the amount of monetary value output from the gaming device in real time.

18. The gaming system of claim 1 wherein the warning signal is generated on a display screen coupled to a gaming network.

19. The gaming system of claim 1 wherein the value tracker is resident on the gaming device.

20. The gaming system of claim 1 wherein the value tracker is resident on a network to which the gaming device is coupled.

21. The gaming system of claim 1 wherein the warning generating system is resident on the gaming device.

22. The gaming system of claim 1 wherein the warning generating system is resident on a network to which the gaming device is coupled.

23. A gaming system, comprising:

a gaming device containing a game to be played by a user;

one or more money trackers structured to track an amount of monetary value accepted into the gaming device, and to track an amount of monetary value output from the gaming device;

a data calculation system coupled to the one or more money trackers, the data calculation system configured to generate a payout warning based on the amount of monetary value accepted into the gaming device and the amount of monetary value output from the gaming device;

wherein the data calculation system includes a jackpot accounting system configured to determine jackpot payouts by tracking individual monetary transactions that are for a jackpot amount, and wherein the data calculation system is configured to exclude jackpot payouts determined by the jackpot accounting system that occur as the result of game play in the amount of monetary value output from the gaming device to prevent an unwarranted payout warning; and a warning generating system coupled to the data calculation system, the warning generating system configured to generate a warning signal responsive to the payout warning of the data calculation system.

24. The gaming system of claim 23 wherein the one or more money trackers is structured to track an amount of monetary value accepted into the gaming device by one or more of: currency, bills, or tokens deposited into the gaming device, credits or cash equivalents transferred to the gaming device, coupons or tickets redeemed by the gaming device or redeemed elsewhere on a gaming network to which the gaming device is coupled, and transfers of bonus, payout or other awards to the gaming device.

25. The gaming system of claim 23 wherein the one or more money trackers is structured to track an amount of monetary value accepted into and output from the gaming device during a time period.

26. The gaming system of claim 23 wherein the one or more money trackers is structured to track an amount of monetary value output from the gaming device by one or more of: currency, bills, or tokens physically discharged from the gaming device, credits or cash equivalents transferred from the gaming device, coupons or tickets generated by the gaming device or generated elsewhere on a computer network to which the gaming device is coupled, handpays generated in response to gaming device commands, and transfers of bonus, payout or other awards to the user of the gaming device.

27. The gaming system of claim 23 wherein the warning signal is a visual signal.

28. The gaming system of claim 23 wherein the warning signal is an audible sound.

29. The gaming system of claim 23 wherein the warning signal is a signal transmitted on a wireless communication system.

30. The gaming system of claim 29 wherein the wireless communication system is a plurality of radios monitoring a same frequency.

31. The gaming system of claim 23 wherein the warning signal comprises creating a list of suspect gaming devices.

32. The gaming system of claim 23 wherein the warning signal comprises creating an entry in an event log.

33. The gaming system of claim 23 wherein the warning generating system is also configured to shut down the gaming device responsive to the payout warning signal.

34. A gaming device that includes a set of game electronics structured to monitor events of the gaming device, comprising:

an input accounter structured to record transactions of monetary value accepted into the gaming device during a time period;

an output accounter structured to record transactions of monetary value generated by the gaming device for the benefit of a game user during the time period;

a warning calculator coupled to the input accounter and the output accounter, the warning calculator structured to generate a payout warning signal based on the recorded transactions, wherein the warning calculator includes a jackpot accounter configured to determine jackpot payouts by tracking individual transactions of monetary value that are for a jackpot amount, and wherein the warning calculator is structured to exclude the jackpot payouts determined by the jackpot accounter to thereby prevent an unwarranted payout warning signal; and a data transmitter coupled to the warning calculator and structured to transmit the warning signal over a communication network coupled to the gaming device.

35. The gaming device of claim 34 wherein the input accounter is structured to track an amount of monetary value accepted into the gaming device by way of one or more of: currency, bills, or tokens deposited into the gaming device, credits or cash equivalents transferred to the gaming device, coupons or tickets redeemed by the gaming device or redeemed elsewhere on a gaming network to which the gaming device is coupled, and transfers of bonus, payout or other awards to the gaming device.

36. The gaming device of claim 34 wherein the output accounter is structured to track an amount of monetary value output from the gaming device by one or more of: currency, bills, or tokens physically discharged from the gaming device, credits or cash equivalents transferred from the gaming device, coupons or tickets generated by the gaming device or generated elsewhere on a computer network to which the gaming device is coupled, handpays generated in response to gaming device commands, and transfers of bonus, payout or other awards to the game user.

37. The gaming device of claim 34 wherein the warning calculator comprises a comparator structured to compare one or more calculated values with one or more predetermined values.

38. The gaming device of claim 34 wherein the warning calculator is structured to generate the payout warning signal when the monetary value generated by the gaming device less the monetary value accepted into the gaming device is above a threshold amount.

39. The gaming device of claim 34 wherein the warning calculator is structured to generate the payout warning signal when the monetary value generated by the gaming device during a time period less an amount of monetary value accepted into the gaming device during the time period is above a threshold amount.

40. The gaming device of claim 34 wherein the set of game electronics further comprises a shutdown circuit structured to prevent gameplay when it receives the warning signal.

41. A system for generating a warning signal based on monetary value transactions at a gaming device, the system comprising:

a game input accounter structured to record transactions of monetary value accepted into the gaming device;

a game output accounter structured to record transactions of monetary value generated by the gaming device;

a warning calculator coupled to the game input accounter and the game output accounter, the warning calculator structured to generate a payout warning signal based on the monetary value accepted into the gaming device and the monetary value generated by the gaming device wherein the warning calculator includes a jackpot accounter configured to determine jackpot payouts by tracking individual transactions of monetary value generated by the gaming device that are for a jackpot amount, and wherein the warning calculator is structured to exclude the jackpot payouts determined by the jackpot accounter to thereby prevent an unwarranted payout warning signal, when determining whether to generate the payout warning signal; and a warning generator coupled to the warning calculator and structured to generate a warning signal responsive to receiving the payout warning signal.

42. The system of claim 41 wherein the input accounter is structured to track an amount of monetary value accepted into the gaming device by way of one or more of: currency, bills, or tokens deposited into the gaming device, credits or cash equivalents transferred to the gaming device, coupons or tickets redeemed by the gaming device or redeemed elsewhere on a gaming network to which the gaming device is coupled, and transfers of bonus, payout or other awards to the gaming device.

43. The system of claim 41 wherein the output accounter is structured to track an amount of monetary value output from the gaming device by one or more of: currency, bills, or tokens physically discharged from the gaming device, credits or cash equivalents transferred from the gaming device, coupons or tickets generated by the gaming device or generated elsewhere on a computer network to which the gaming device is coupled, handpays generated in response to gaming device commands, and transfers of bonus, payout or other awards to a user of the gaming device.

44. The system of claim 41 wherein the warning calculator is structured to generate the payout warning signal when the monetary value generated by the gaming device during a time period less the monetary value input accepted into the gaming device during the time period is above a threshold amount.

45. A method for providing an accounting safeguard on a networked gaming device, comprising:

recording an individual amount of monetary value paid by the gaming device;

tracking the individual amount of monetary value paid by the gaming device to determine if the individual amount of monetary value paid by the gaming device is for a jackpot amount;

comparing the individual amount of monetary value paid by the gaming device to one or more predetermined values, including obtaining the individual amount of monetary value paid by the gaming device, subtracting an individual amount of monetary value accepted into the gaming device from the individual amount of monetary value paid by the gaming device to obtain a difference value, further subtracting the individual amount of monetary value paid by the gaming device from the difference value if the individual amount of monetary value paid by the gaming device is determined to be for the jackpot amount to thereby prevent an unwarranted payout warning signal, and comparing the difference value to one or more predetermined values, wherein the one or more predetermined values is modified during the operation of the gaming machine such that the one or more predetermined values is a function of the duration of a period of time associated with the one or more predetermined values; and issuing a warning if the amount of monetary value paid by the gaming device exceeds the one or more predetermined values.

46. The method of claim 45, further comprising generating one or more predetermined values by tracking an amount of monetary value accepted into the gaming device by way of one or more of: currency, bills, or tokens deposited into the gaming device, credits or cash equivalents transferred to the gaming device, coupons or tickets redeemed by the gaming device or redeemed elsewhere on a gaming network to which the gaming device is coupled, and transfers of bonus, payout or other awards to the gaming device.

47. The method according to claim 45 wherein recording an amount of monetary value paid by the gaming device comprises recording an amount of monetary value paid by the gaming device via one or more of: currency, bills, or tokens physically discharged from the gaming device, credits or cash equivalents transferred from the gaming device, coupons or tickets generated by the gaming device or generated elsewhere on a computer network to which the gaming device is coupled, handpays generated in response to gaming device commands, and transfers of bonus, payout or other awards to a user of the gaming device.

48. The method of claim 45 wherein issuing a warning if the amount of monetary value paid by the gaming device exceeds the one or more predetermined values comprises:

when the amount of monetary value paid by the gaming device exceeds the highest of the one or more predetermined values, issuing a first type of warning; and when the amount of monetary value paid by the gaming device does not exceed the highest of the one or more predetermined values, but does exceed a second highest of the one or more predetermined values, issuing a second type of warning.

49. The method of claim 45, further including prohibiting a game on the gaming device from operating if the gaming device issues a warning.

50. The method of claim 45 wherein issuing a warning comprises generating a visual signal.

51. The method of claim 45 wherein issuing a warning comprises generating an event log entry.

52. The method of claim 45, further comprising transmitting a warning signal over a gaming network.

* * * * *